US012760987B2

(12) United States Patent
DeSomma et al.

(10) Patent No.: US 12,760,987 B2
(45) Date of Patent: Oct. 13, 2026

(54) RIFLE

(71) Applicant: Patriot Ordnance Factory, Inc., Phoenix, AZ (US)

(72) Inventors: Frank DeSomma, Phoenix, AZ (US); Zachery Clark, Phoenix, AZ (US)

(73) Assignee: Patriot Ordnanace Factory, Inc., Phoenix, AZ (US)

( * ) Notice: Subject to any disclaimer, the term of this patent is extended or adjusted under 35 U.S.C. 154(b) by 0 days.

(21) Appl. No.: 19/034,563

(22) Filed: Jan. 23, 2025

(65) Prior Publication Data

US 2025/0244102 A1 Jul. 31, 2025

(51) Int. Cl.
*F41C 7/06* (2006.01)

(52) U.S. Cl.
CPC ..... *F41C 7/06* (2013.01)

(58) Field of Classification Search
CPC ..... F41C 7/06
See application file for complete search history.

(56) References Cited

U.S. PATENT DOCUMENTS

| | | | | |
|---|---|---|---|---|
| 11,156,421 | B2 * | 10/2021 | Dunham | F41A 11/00 |
| 11,988,480 | B2 * | 5/2024 | Tusting | F41C 7/06 |
| 12,442,603 | B2 * | 10/2025 | Moore | F41A 3/72 |
| 2024/0085128 | A1 * | 3/2024 | Ader | F41A 3/72 |

* cited by examiner

*Primary Examiner* — Reginald S Tillman, Jr.
(74) *Attorney, Agent, or Firm* — Mark Williams, P.C.

(57) ABSTRACT

Rifles of the present disclosure may comprise a stock a, a receiver assembly, and a barrel. The receiver assembly may comprise a bolt, a trigger system, a lever, and a linkage. The receiver assembly installed in the stock. The linkage may comprise a first link having a first end and a second end, the first end rotatably coupled to the bolt. The linkage may further comprise a second link have a third end and a fourth end, the third end being rotatably coupled to the second end. The linkage may also comprise a third link having a fifth end and two arms coupled to the fifth end defining a channel, the fifth end rotatably coupled to the fourth end. The lever being slidably installed in the channel and configured to move the bolt between an in-battery and an out-of-battery position.

1 Claim, 11 Drawing Sheets

RIFLE

CROSS-REFERENCE TO RELATED APPLICATIONS

This application claims the benefit of U.S. Provisional Patent Application 63/623,764 filed on Jan. 22, 2024 and entitled, "RIFLE," which is incorporated herein by reference in its entirety for all purposes.

FIELD

This invention relates to lever action rifles.

BACKGROUND

Lever action rifles are well known. However, they generally have long lever actuation cycles and their trigger's do not break crisply, leaving the user with a less-than-optimal experience. As such, there is a need to a short cycle lever action rifle with an improved trigger.

SUMMARY

In various embodiments, a rifle may comprise a stock a, a receiver assembly, and a barrel. The receiver assembly may comprise a bolt, a trigger system, a lever, and a linkage. The receiver assembly installed in the stock. The linkage may comprise a first link having a first end and a second end, the first end rotatably coupled to the bolt. The linkage may further comprise a second link have a third end and a fourth end, the third end being rotatably coupled to the second end. The linkage may also comprise a third link having a fifth end and two arms coupled to the fifth end defining a channel, the fifth end rotatably coupled to the fourth end. The lever being slidably installed in the channel and configured to move the bolt between an in-battery and an out-of-battery position.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

SPECIFICATION

The detailed description of exemplary embodiments herein refers to the accompanying drawings, which show exemplary embodiments by way of illustration. While these exemplary embodiments are described in sufficient detail to enable those skilled in the art to practice the inventions, other embodiments may be realized, and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Figure 1:
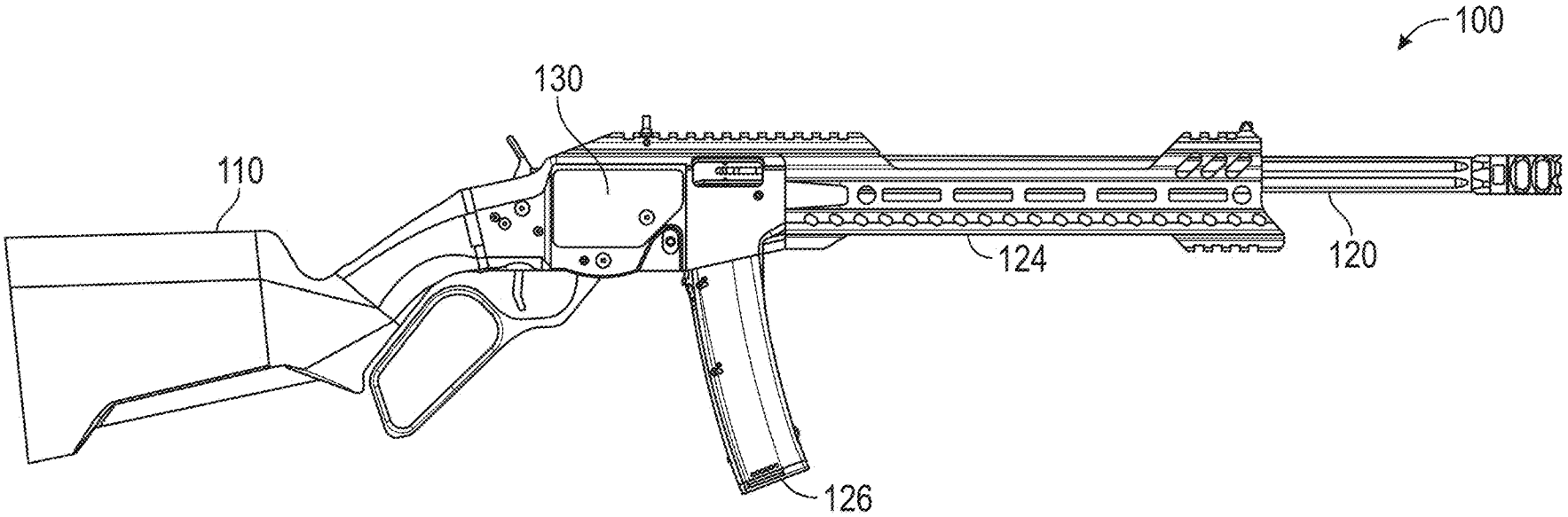
FIG. 1 is a side view of a rifle, according to various embodiments.

In various embodiments and with reference to FIG. 1, a rifle 100 may comprise a stock 110, a barrel 120 and a receiver assembly 130. Rifle 100 may be chambered in any suitable caliber including, for example, any suitable pistol, rifle, or shotgun caliber or load. Rifle 100 may further comprise a rail 124 that is installable over barrel 120 and is operatively coupled to receiver assembly 130. Rifle 100 may also comprise a detachable magazine 126 that is removable installed within receiver assembly 130.

Figure 2:
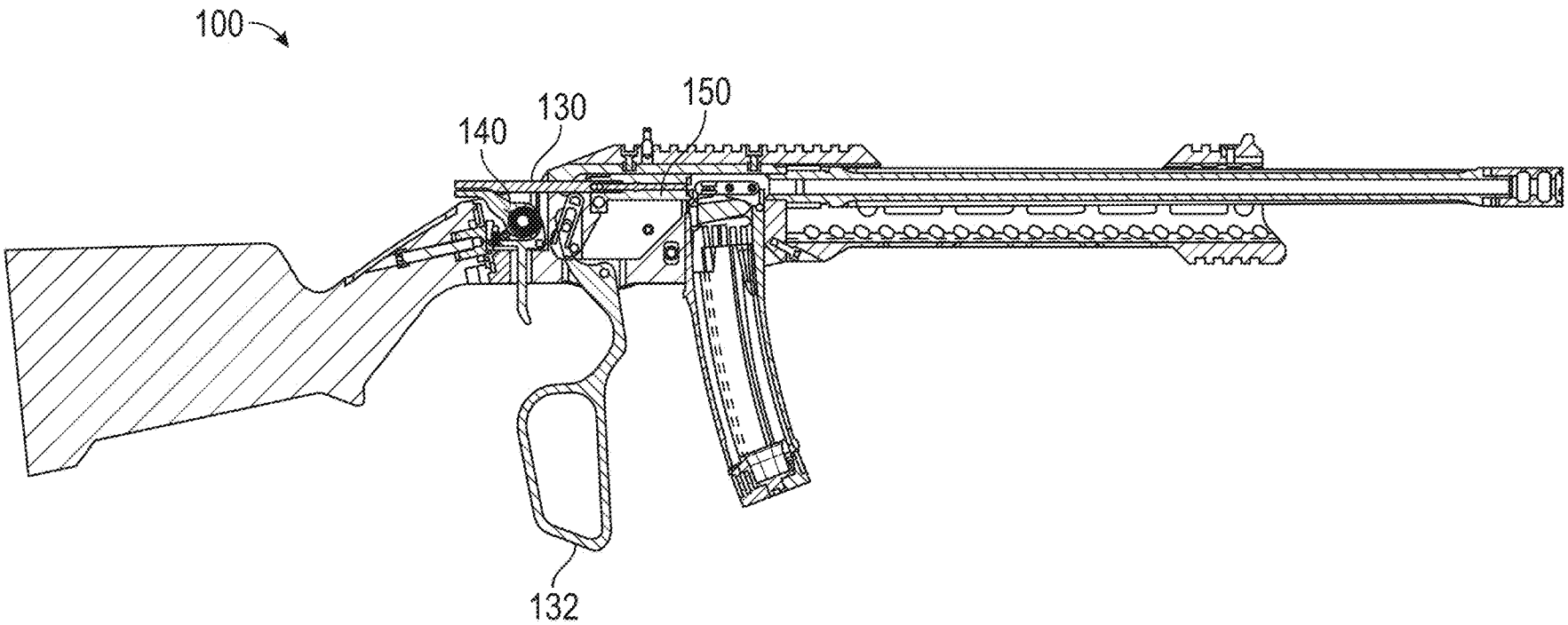
FIG. 2 is a side cross-sectional view of a rifle, according to various embodiments.

In various embodiments and with reference to FIG. 2, receiver assembly 130 of rifle 100 may further comprise a lever 132. Receiver assembly 130 may also comprise a trigger system 140 that is operatively coupled to level 132 and linkage 150.

Figure 3:
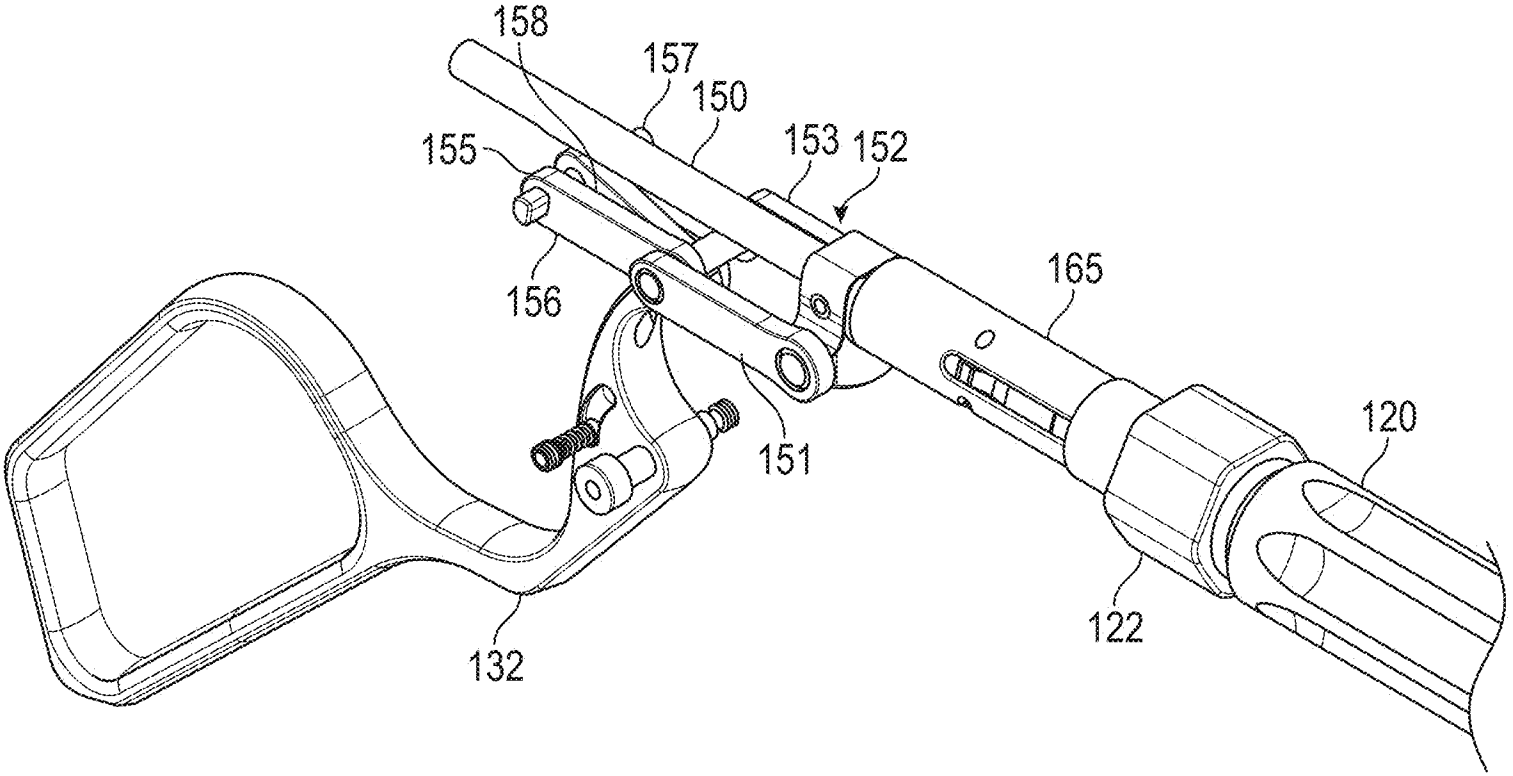
FIG. 3 is first view of a portion of the receiver assembly and barrel in an in-battery configuration, according to various embodiments.
Figure 4:
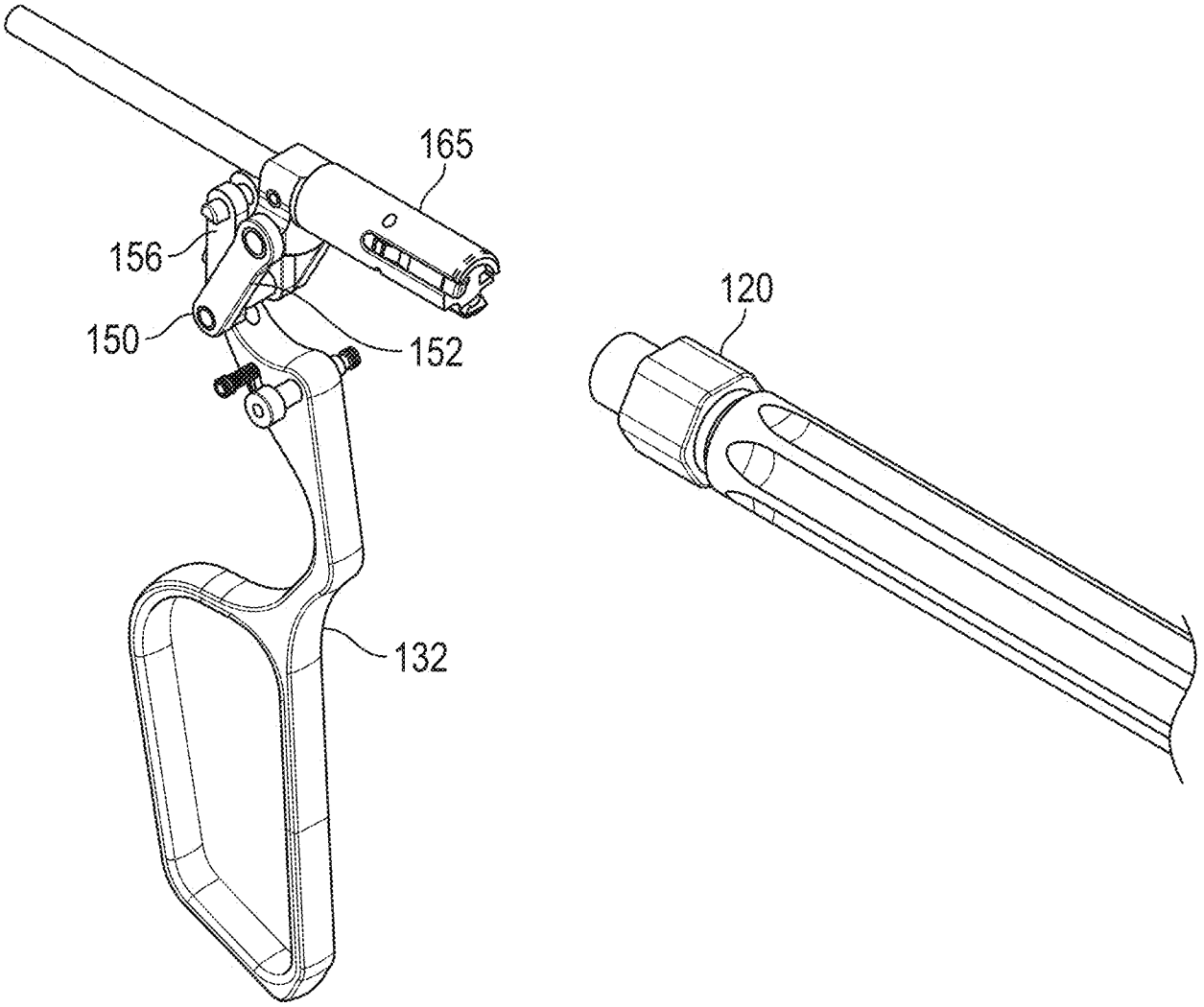
FIG. 4, is a second view of a portion of the receiver assembly and barrel in an out-of-battery configuration, according to various embodiments.
Figure 5:
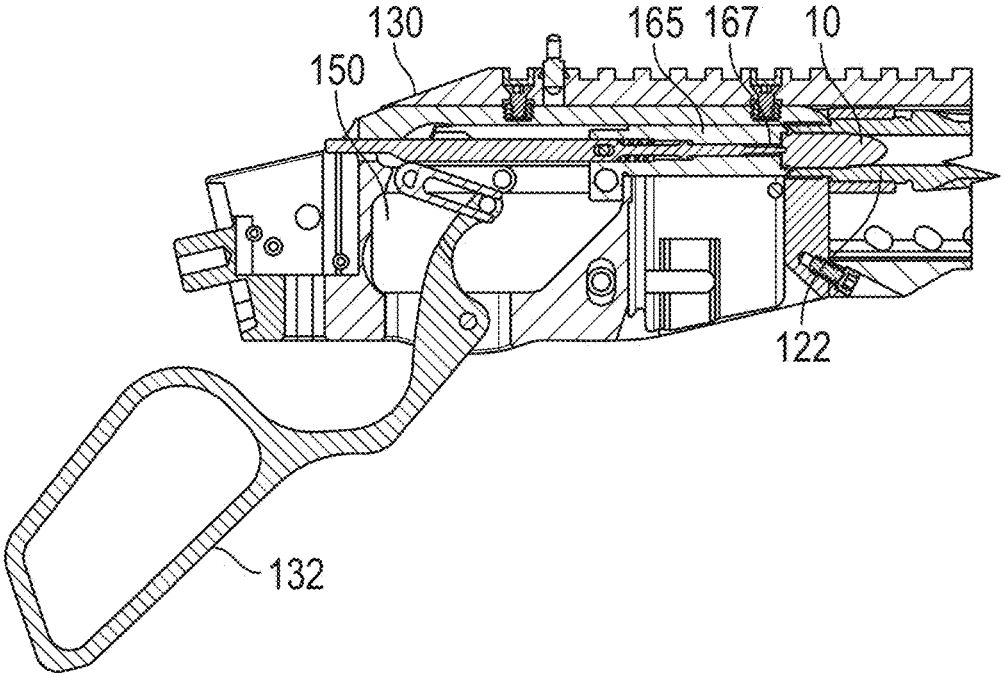
FIG. 5 is a first side cross-sectional view of a portion of the receiver assembly and barrel in an in-battery configuration, according to various embodiments.

In various embodiments and with reference to FIG. 3 and FIG. 4, linkage 150 is operatively couple to lever 132 and bolt group 165. As shown in FIG. 3, bolt group 165 is installable in an in-battery configuration into barrel 120 and/or barrel extension 122. Linkage 150 may comprise a first link 152 and a second link 156. Link 152 may comprise a first arm 151 and a second arm 153 disposed substantially parallel to one another. Link 152 may be operatively coupled at a first end to bolt group 165 via a pin, a similar connecting device, and/or a fastener. Link 152 may also be operatively coupled to link 156 at a second end of link 152 a first end of link 156.

In various embodiments, link 156 may comprise a third arm 155 and a fourth arm 157 disposed substantially parallel to one another and pinned at the first end of linkage 156 and to the second end of linkage 152. Second link is 156 may further comprise a central link 158. That is operatively couple two and/or pinned to the second end of linkage 156 at a first end of central link 158. A second end of central link 158 maybe operatively couple to and/or pinned to lever 132 at a distal end of lever 132, which may be substantially disposed in the receiver assembly. In this regard, actuation of lever 132 may cause linkage assembly 150 to actuate bolt group 165 from an in-battery position as shown in FIG. 3 to an out-of-battery position shown in FIG. 4.

In various embodiments and with reference to FIG. 5, FIG. 6, FIG. 7 and FIG. 8, bolt group 165 may further comprise a firing pin 167 that is disposed in and passes through a portion of bolt group 165. Bolt group 165 may be installed in and positioned in an in-battery configuration within receiver assembly 130, in response to lever 132 being actuated from the out-of-battery position to the in-battery position. Bolt group 165 may be actuated by linkage assembly 150 and/or lever 132 from the out-of-battery position to the in-battery position. In the in-battery position, firing pin 167 may be configured to engage and/or ignite a projectile 10 (e.g., a bullet or shell) that is disposed within barrel 120 and/or barrel extension 122.

Figure 6:
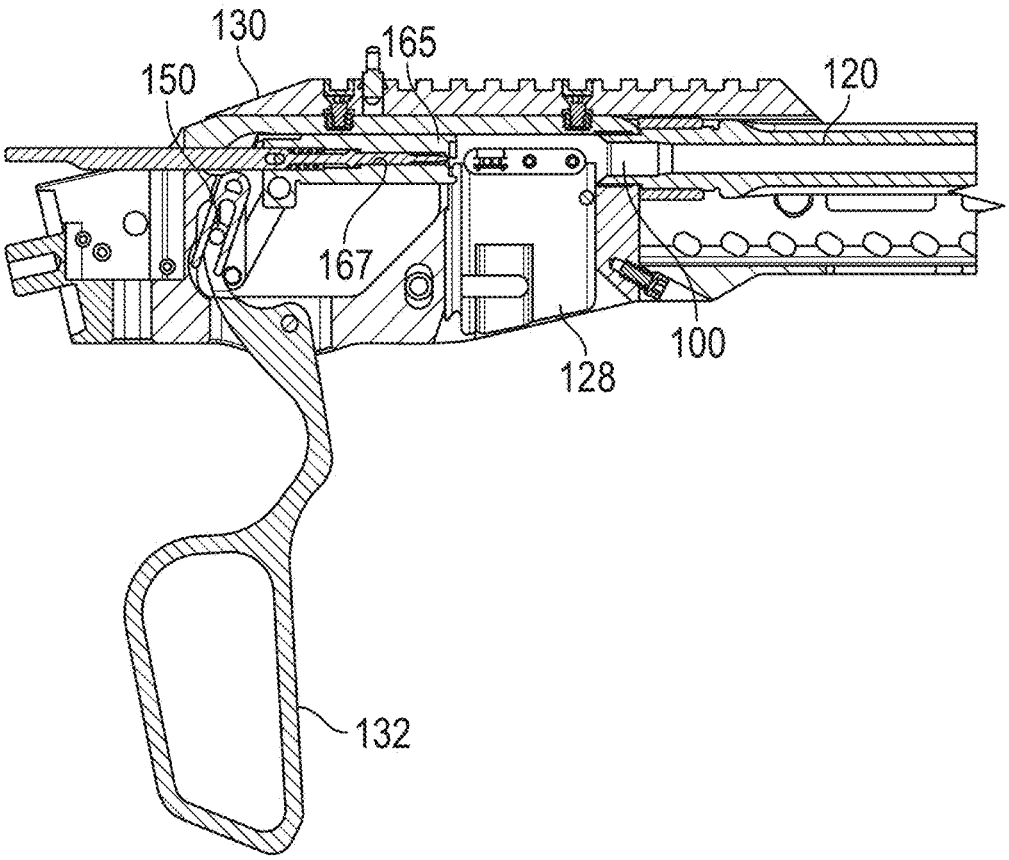
FIG. 6 is a second side cross-sectional view of a portion of the receiver assembly and barrel in an out-of-battery configuration, according to various embodiments.

With specific reference to FIG. 6, when bolt assembly 165 is in the out-of-battery position projectiles provided through magazine well 128 via detachable magazine 126 (as shown in FIG. 1) may be advanced into barrel 120 and/or barrel extension 122 by actuating lever 132 from the out-of-battery position to the in-battery position.

Figure 7:
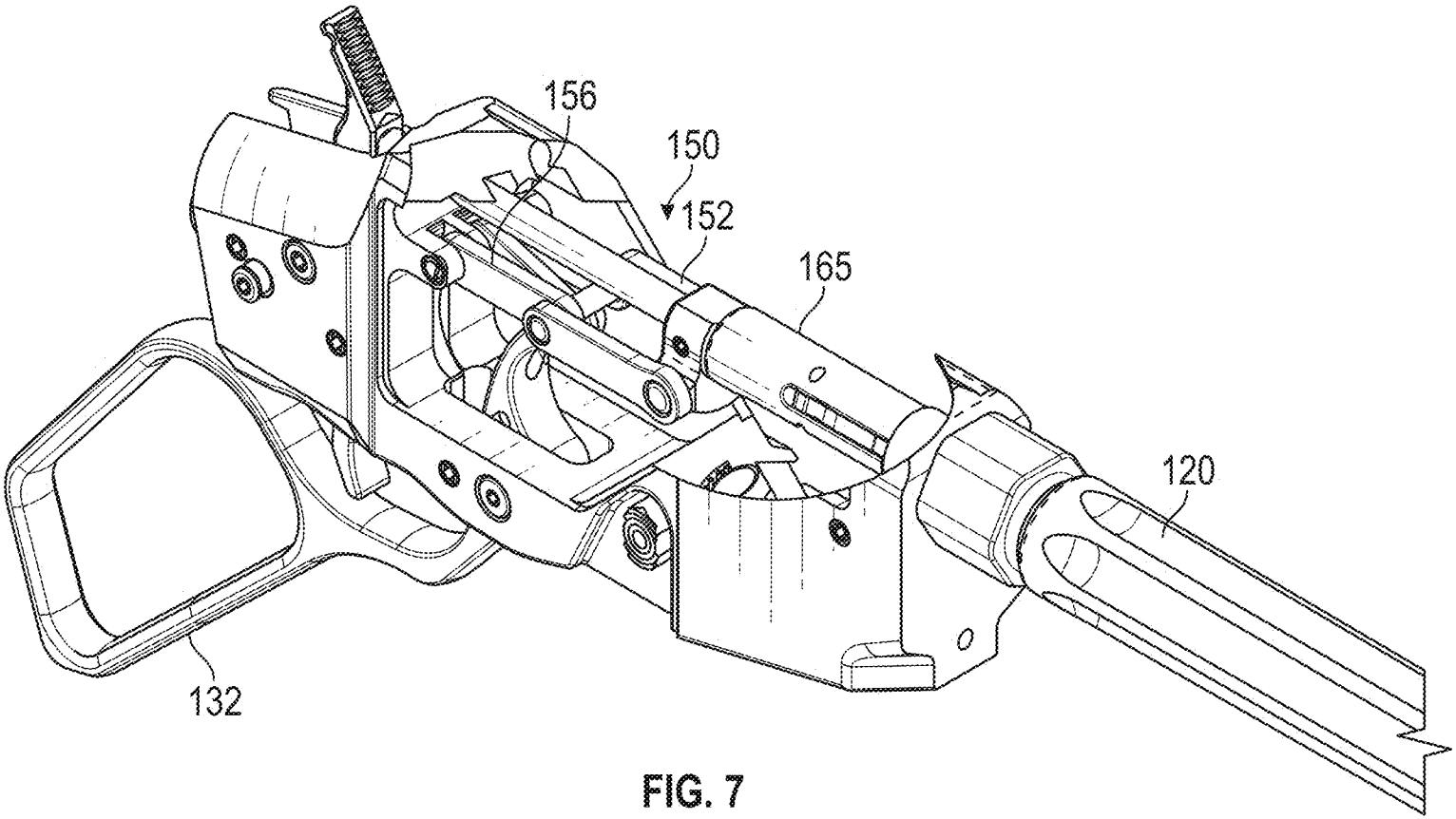
FIG. 7 is a first perspective view of a portion of the receiver assembly and barrel in an in-battery configuration, according to various embodiments.
Figure 8:
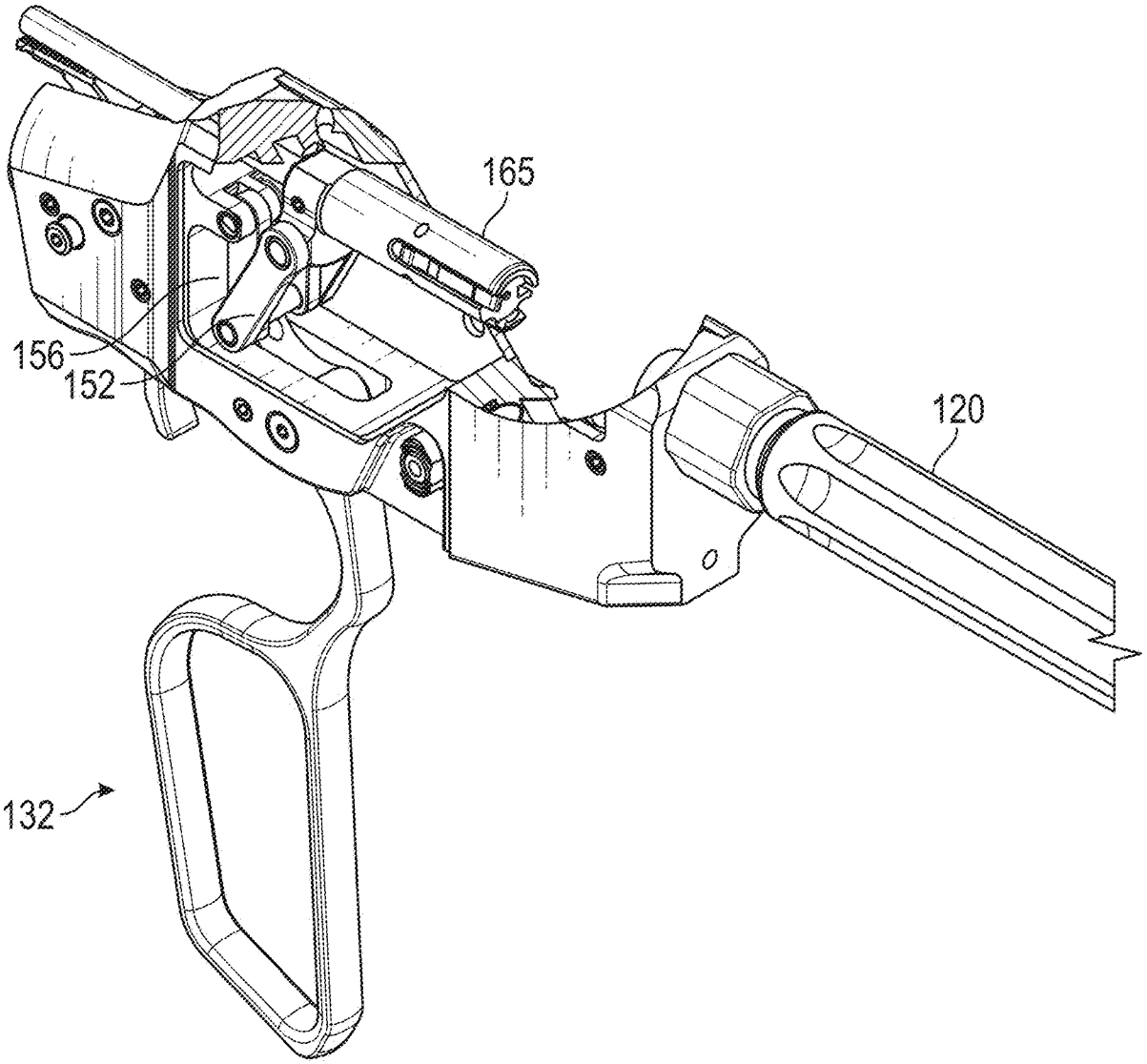
FIG. 8 is a second perspective view of a portion of the receiver assembly and barrel in an out-of-battery configuration, according to various embodiments.

With specific reference to FIG. 7, in the in-battery position link 152 and link 156 of linkage assembly 150 are aligned with one another and are substantially parallel to one another. This geometric arrangement provides a rigid linkage assembly 150 when bolt group 165 is in the in-battery position.

Figure 9:
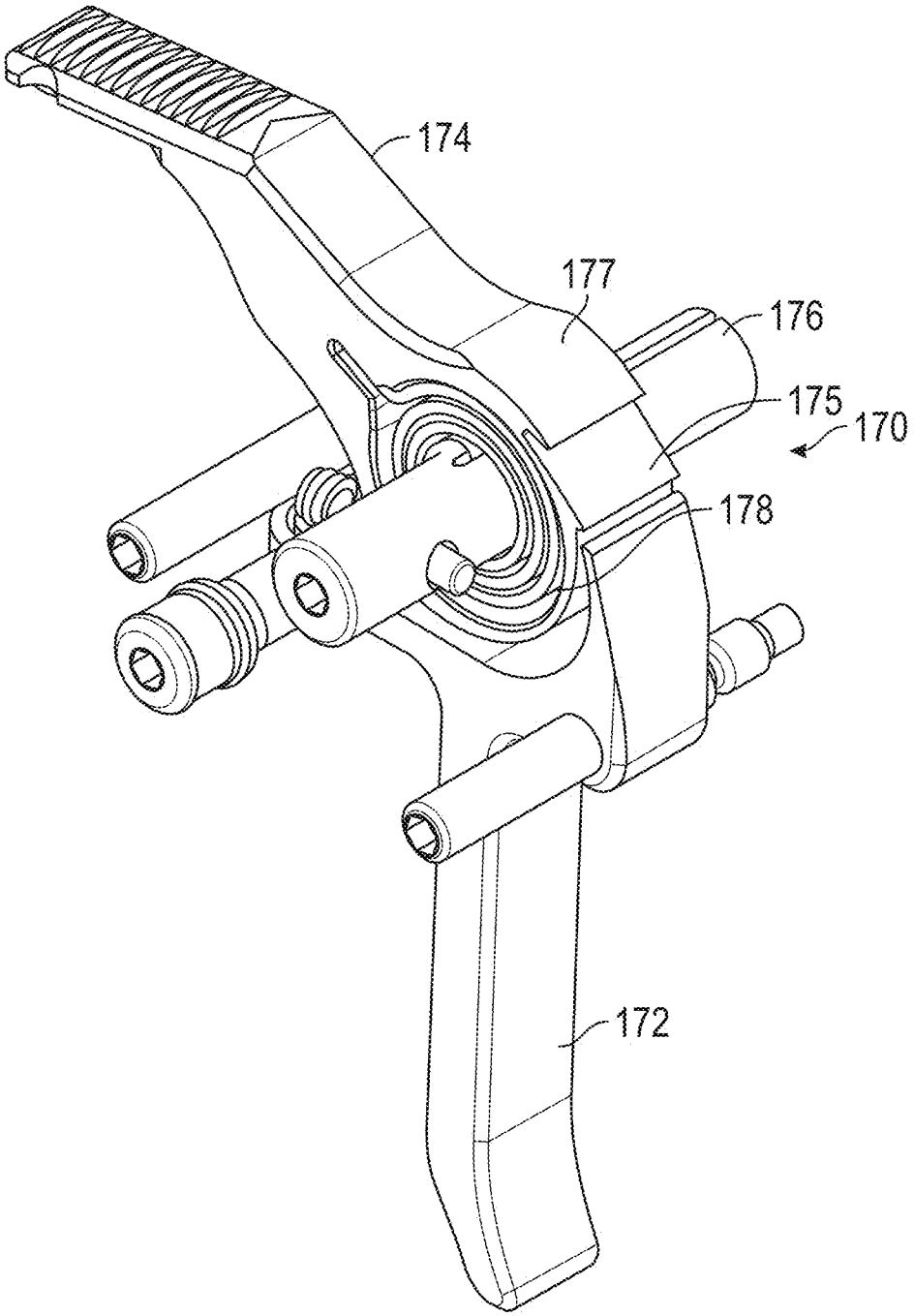
FIG. 9 is a perspective view of a trigger assembly, according to various embodiment.
Figures 10A, 10B, 10C:
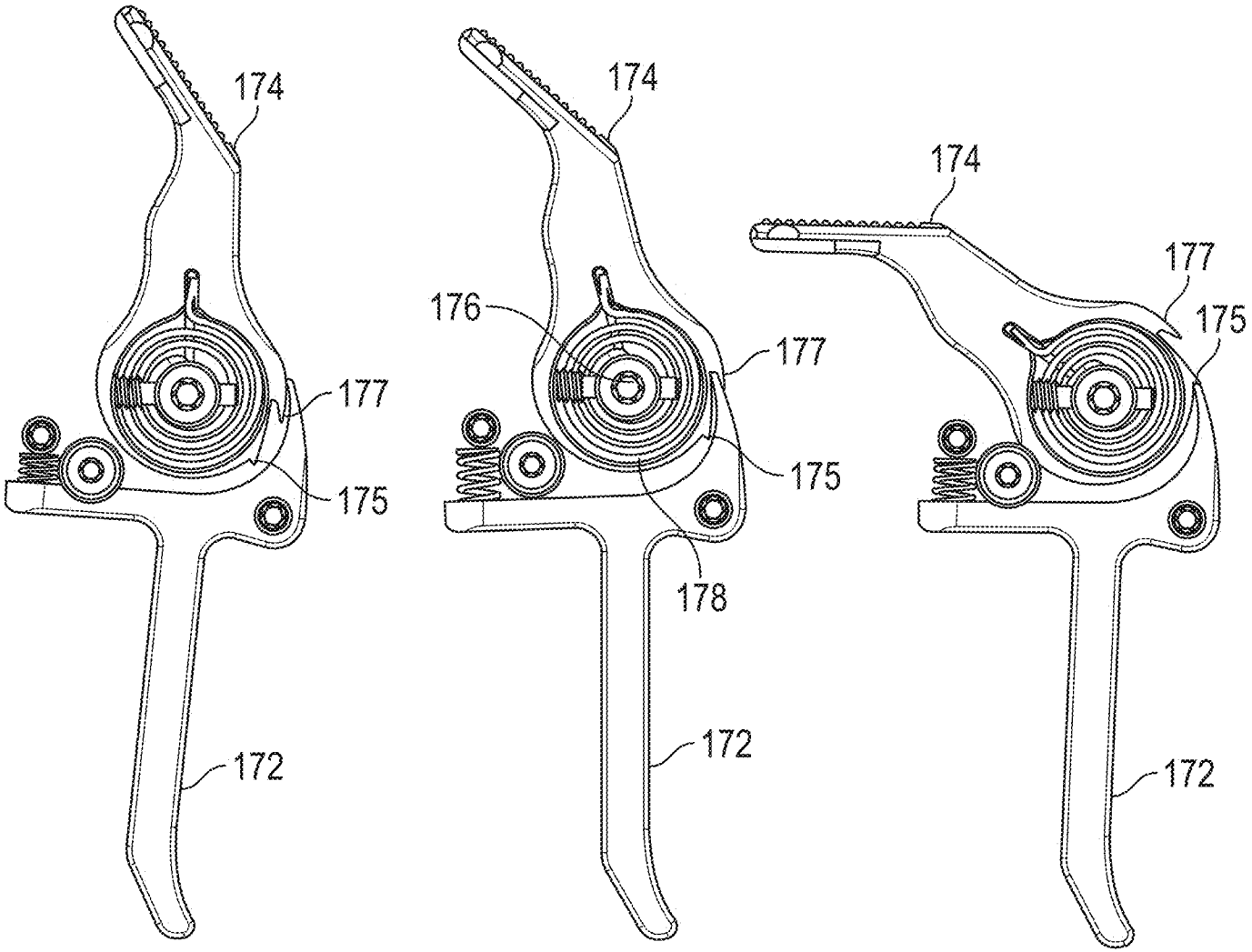
FIG. 10A is a first side view of a trigger assembly in a neutral position, according to various embodiments.
FIG. 10B is a first side view of a trigger assembly in a first cocked position, according to various embodiments.
FIG. 10C is a first side view of a trigger assembly in a fully cocked position, according to various embodiments.

In various embodiments and with reference to FIG. 9 and FIGS. 10A through 10 C, rifle 100 may comprise a trigger assembly 170. Trigger assembly 170 may comprise a trigger shoe 172, a hammer 174, and a coil spring 178. Coil spring 178 may be captured in and/or disposed in hammer 174. Moreover, coil spring 178 may be configured to interact with trigger shoe 172 in response to hammer 174 being actuated from a neutral position, as shown in FIG. 10*a*, to a first cocked position as shown in FIG. 10 B. In this regard trigger you 172 may be configured to engage and or catch a first tooth 177 of hammer 174 when hammer 174 is actuated from a neutral position to a first cocked position. In response to hammer 174 being cocked from a first cock position to a fully cocked position, trigger you 172 May engage a second tooth 175 of hammer 174. As hammer 174 is actuated to a first cocked position and a fully cocked position, the tension of coil spring 176 may increase in each position. Coil spring 178 may be retained on a central shaft 176 disposed within a central access of coil Spring 178.

Figure 11A:
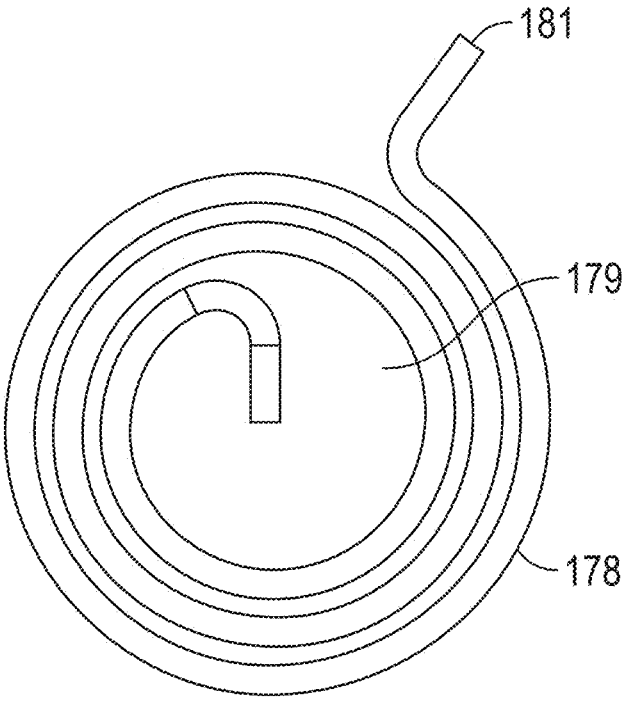
FIG. 11A is the first side view of a coil spring in a first position, according to various embodiments.
Figure 11B:
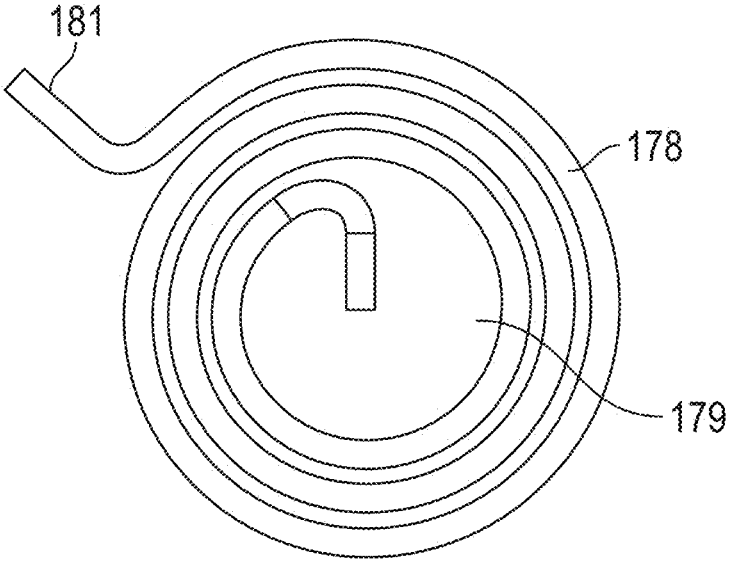
FIG. 11B is the first side view of a coil spring in a second position, according to various embodiments.

In various embodiments and with reference to FIG. 11*a* and FIG. 11 B, coil spring 178 may comprise a first tab that is configured to engage central shaft 176 and second tab 181 that is configured to engage hammer 174.

Figure 12A:
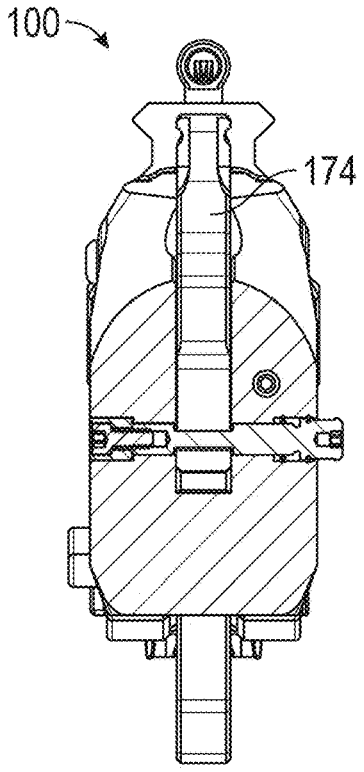
FIG. 12A is the rear cross-sectional view of a rifle with a hammer in the first position, according to various embodiments.
Figure 12B:
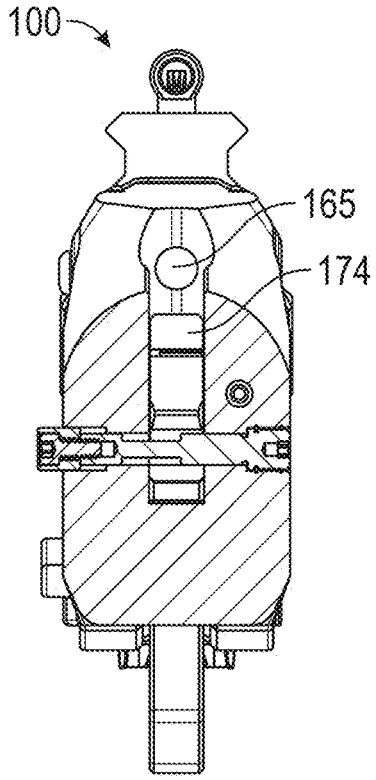
FIG. 12B is the rear cross-sectional view of a rifle with a hammer in the fully cocked position, according to various embodiments.

In various embodiments and with reference to FIG. 12*a* and FIG. 12 B, rifle 100 may be actuated by caulking hammer 174 from a first position and or a neutral position to a second position and or a fully cocked position. In this regard, in response to trigger assembly 170 being actuated hammer 174 may strike a portion of bolt group 165 causing rifle 100 to discharge a projectile 10.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular examples. Functionality may be separated or combined in blocks differently in various implementations of the disclosure or described with different terminology. These and other variations, modifications, additions, and improvements may fall within the scope of the disclosure as defined in the claims that follow.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A rifle, comprising:

a stock;

a receiver assembly comprising a bolt, a trigger system, a lever, and a linkage, the receiver assembly installed in the stock;

wherein the linkage system comprises, a first link having a first end and a second end, the first end rotatably coupled to the bolt, a second link have a third end and a fourth end, the third end being rotatably coupled to the second end, a third link having a fifth end and two arms coupled to the fifth end defining a channel, the fifth end rotatably coupled to the fourth end, the lever being slidably installed in the channel and configured to move the bolt between a battery and an out of battery position; and a barrel operatively coupled to the receiver assembly.

* * * * *